United States Patent [19]

Daicho et al.

[11] 4,341,245

[45] Jul. 27, 1982

[54] GAS INLET ATTACHMENT FOR A GAS CHARGER

[75] Inventors: Norio Daicho, Amagasaki; Keitaro Yonezawa, Kobeshi, both of Japan

[73] Assignee: Kabushiki Kaisha Neriki, Hyogoken, Japan

[21] Appl. No.: 136,495

[22] Filed: Apr. 3, 1980

[30] Foreign Application Priority Data

Apr. 6, 1979 [JP] Japan ..... 54-46147[U]

[51] Int. Cl.[3] ..... B65B 3/04

[52] U.S. Cl. ..... 141/18; 141/346; 137/509

[58] Field of Search ..... 141/2, 18, 21, 285–310, 141/346–362; 137/509, 587, 588; 220/85 R, 85 VR, 85 VS

[56] References Cited

U.S. PATENT DOCUMENTS 4,210,168 7/1980 Yonezawa ..... 141/18

FOREIGN PATENT DOCUMENTS 2378968 9/1978 France ..... 137/509

*Primary Examiner*—Houston S. Bell, Jr.

*Attorney, Agent, or Firm*—Bacon & Thomas

[57] ABSTRACT

A gas-inlet attachment includes an air-tightly sealed pressure differentiator in the mouthpiece of a gas charger, wherein the pressure differentiator includes a valve-opener slidably and air-tightly connectable to the check valve in the cock with a pressure differentiating space interposed therebetween, thereby enabling the check valve to be biased in its opening direction under the differentiated pressure provided by the pressure differentiator.

6 Claims, 10 Drawing Figures

GAS INLET ATTACHMENT FOR A GAS CHARGER

BACKGROUND OF THE INVENTION

1. Field of the Invention

The present invention relates to a gas-inlet attachment for use in charging a gas container with a fresh supply of gas. More particularly, the present invention relates to a gas-inlet attachment for inclusion in the mouthpiece of a gas charger, wherein the gas-inlet attachment includes an air-tightly sealed pressure differentiator allowing the check valve in the cock to open under a differentiated pressure against the charging gas pressure, thereby facilitating the gas charging operation, and also avoiding a leakage problem.

2. Description of the Prior Art

It is the common practise to employ a check valve in a plug-cock type of valve for preventing an outside air containing impurities, such as dust and dirt, from entering the container when it is empty; otherwise, a freshly charged gas is in danger of contamination with the impurities.

However, to supply gas to the container, the check valve must be kept open. To open it, various proposals have been offered, among which is a special attachment for opening the check valve by the charging gas per se, as will be described more fully hereinafter. This prior art attachment has an advantage of dispensing with the necessity of employing any special tool or device for opening the check valve, but it has been found that the advantage is traded off by many disadvantages, such as:

1. It is unavoidable for some portion of the charging gas to leak into the atmosphere. This will be of particular disadvantage when the gas is of toxic or explosive nature;

2. A gas-inlet mouthpiece must be made specially for the mouthpiece. This leads to a high production cost.

3. The attachment tends to be heavy with a relatively large gas-inlet mouthpiece; with such a heavy attachment it is time- and labor-consuming to fix it on the cock with its gas-inlet passage being in alignment with the gas-outlet passage of the cock. In addition, there is a danger of damaging the check valve in the cock.

The aim underlying the present invention essentially resides in providing an improved gas-inlet attachment which can allow the check valve to open by a charging gas without the possibility of leakage problems, and which is readily applicable to ready-made cocks.

SUMMARY TO THE INVENTION

According to an advantageous feature of the present invention, a gas-inlet attachment includes an air-tightly sealed pressure differentiator in the mouthpiece of a gas charger, wherein the pressure differentiator includes a valve-opener slidably connectable to the check valve in the cock with a pressure differentiating space therebetween, thereby enabling the pressure differentiator to constitute a low pressure in the space against the charging gas pressure exerting on the check valve in its closing state.

DETAILED DESCRIPTION OF THE INVENTION

Figure 1:
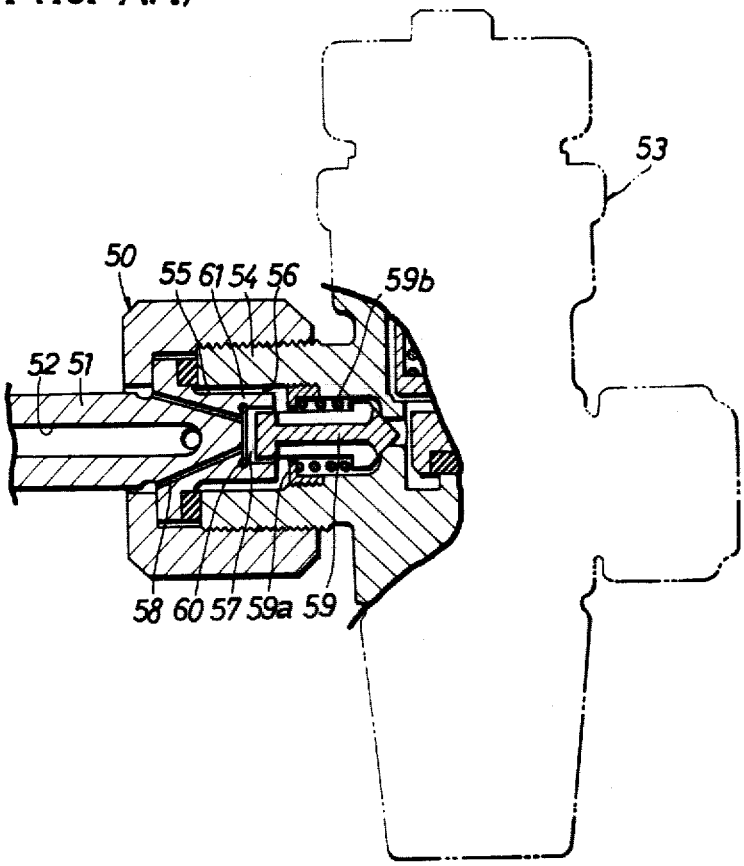
Fig. 1 (Prior Art)
FIG. 1 is a cross sectional view of a prior art gas-inlet attachment.

For a better understanding of the present invention, a prior art gas-inlet attachment will be explained:

In FIG. 1, the prior art gas-inlet attachment 50 is detachably fixed on a cock 53 of a gas container (not shown). The attachment 50 has internal threads to be engageable with the external threads on an outlet mouthpiece 54. In addition, the attachment 50 has an inlet mouthpiece 51 in which an inlet passage 52 is produced. The outlet mouthpiece 54 has an outlet passage 55. The attachment 50 is fixed to the outlet mouthpiece 54 such that the inlet passage 51 communicates with the outlet passage 55. Reference numeral 59 denotes a check valve built in the cock 53. The attachment 50 has by-passes 58 communicating with the atmosphere for escaping some portion of the charging gas outside to reduce the pressure in the inlet mouthpiece, and the remaining portion of gas is introduced into a space 56 in which it exerts on the shoulders 59*a* of the check valve 59, thereby biasing the check valve leftward against the spring 59*b*. Reference numeral 57 denotes a chamber in which the check valve is allowed to withdraw under the gaseous pressure. When the check valve 59 is fully biased to the left, the by-passes 58 are closed by the end portion of the check valve fitted with O-rings 60, thereby stopping the leakage of gas into the atmosphere.

The advantage of this prior art gas-inlet attachment resides in the provision of the chamber 57 which functions as a pressure differentiator against the upstream side of the check valve where it is normally kept in its closing state. However, the gas-inlet mouthpiece 51 is not movable; consequently, to avoid a build-up of pressure, the by-passes 58 are required for escaping the pressure into the atmosphere. However, this advantage is traded off by the following disadvantages:

1. To operate the attachment, it is unavoidable from some portion of a charging gas to leak into the atmosphere. When the gas is explosive or toxic, the attachment cannot be used.

2. The attachment must have a specially made gas-inlet mouthpiece.

3. The attachment is heavy, and is difficult to fix on the cock such that the gas-inlet passage 52 is in alignment with the outlet passage 55. This is a time- and labor-consuming operation. It occasionally happens that the check valve is damaged.

Figure 2:
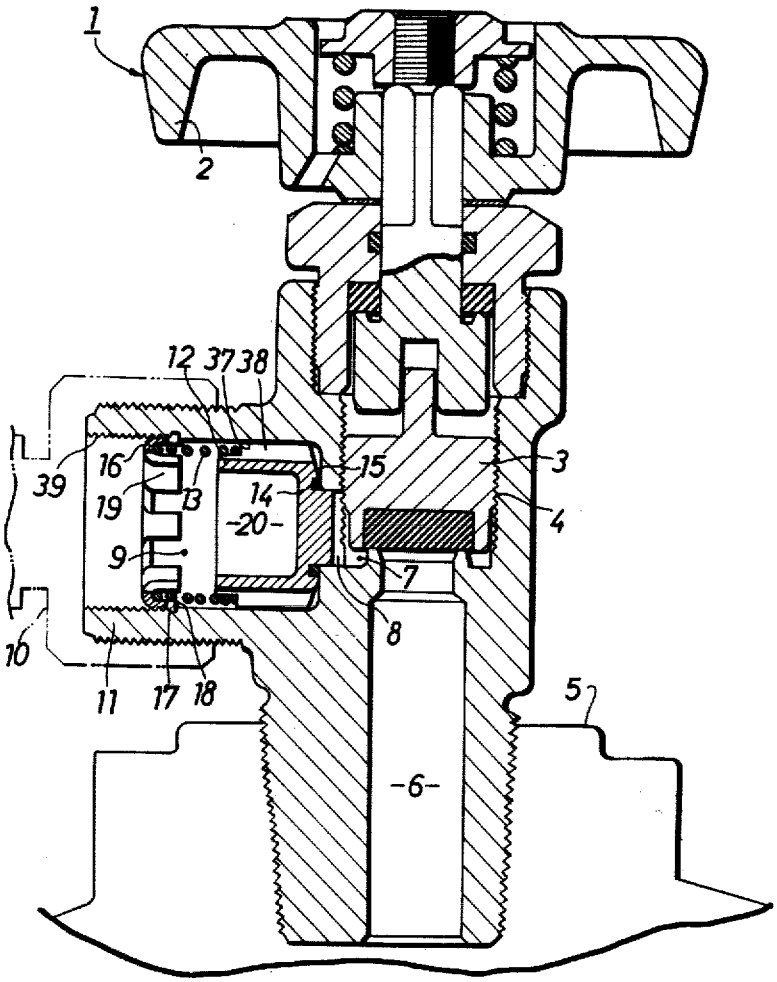
FIG. 2 is a cross sectional view of a cock when it is in use.
Figure 3:
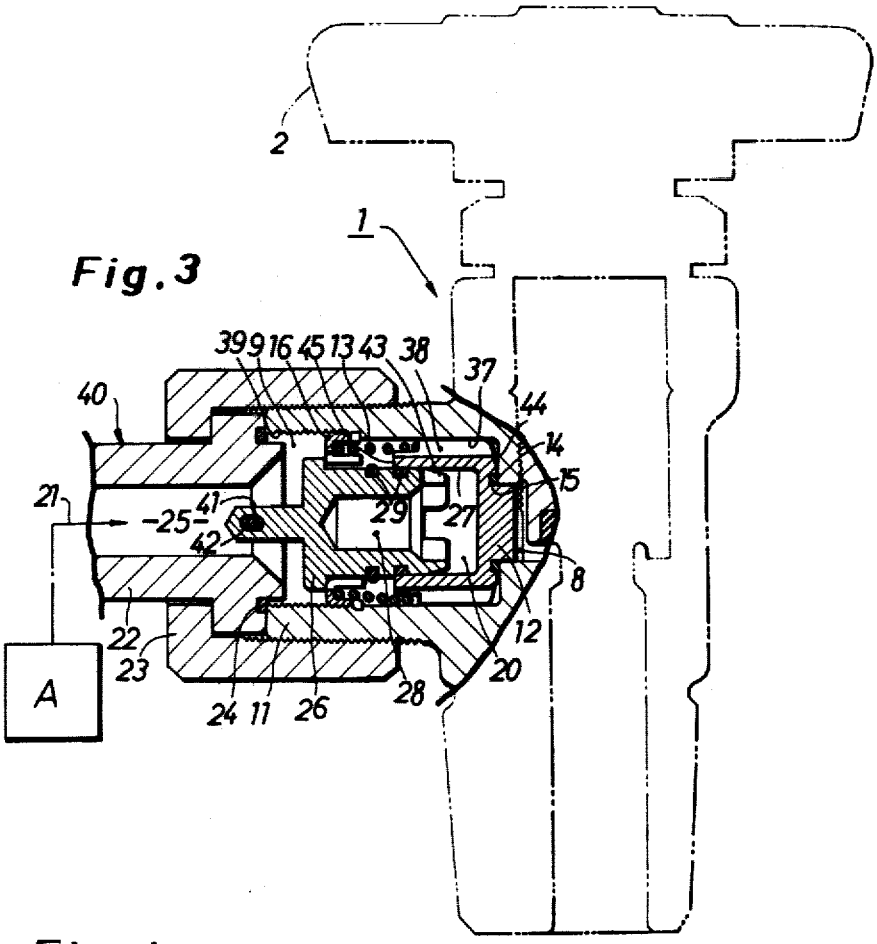
FIG. 3 is a cross sectional view showing a cock with a gas-inlet attachment in accordance with the present invention.

Referring now to FIGS. 2 and 3, a cock including a check valve 12 is generally designated by reference numeral 1, wherein reference numeral 2 denotes a handle-wheel whereby a main valve 3 is opened and closed by the engagement of threads 4. The cock 1 is detachably fixed on a gas container 5 when the contained gas is to be discharged or a gas is to be freshly charged. When the main valve 3 is opened the contained gas is led to the outside via a passage 6, a main-valve chamber 7, an outlet port 8, an outlet passage 9 and a takeout pipe 10.

The cock 1 is provided with an outlet mouthpiece 11 in which the outlet passage 9 is passed. The check valve 12 is located in the outlet passage 9, which normally closes the outlet port 8 under the action of a spring 13. The plug face of the check valve is fitted with an O-ring 14 so as to sealingly fit in the outlet port 8. Reference numeral 15 denotes a valve seat which is located in the outlet port 8 and shaped so as to receive the plug face of the check valve.

The check valve 12 is provided with ribs 37 and grooves 38 alternately produced on its outside surface. The ribs 37 are designed so as to enable the check valve to smoothly move in the outlet chamber 9 with minimum friction, and the grooves 38 are designed so as to allow the gas to pass therethrough. Each rib is in slight contact with the inside wall of the outlet passage 9.

The outlet passage 9 is provided with threads 39 in its entrance portion, in which a ring-shaped seat metal 16 is screwed for supporting a spring 13. The seat metal 16 is provided with a tenon 17 adapted to be inserted into a ring-shaped recess 18 produced in the terminating end of the threads 39, thereby enabling the seat metal 16 to anchor therein. The seat metal 16 is provided with projections 19 projecting toward the check valve 12, the projection being designed so as to stop the check valve from its further movement. The check valve 12 includes a recess 20 which opens toward the projections 19. The recess 20 is designed so as to constitute a pressure difference against the charging gas pressure exerting on the upstream side of the check valve 12, thereby allowing the check valve to be biased in its opening direction until the same comes into abutment with the projections 19, as will be described more fully hereinafter.

Figure 4:
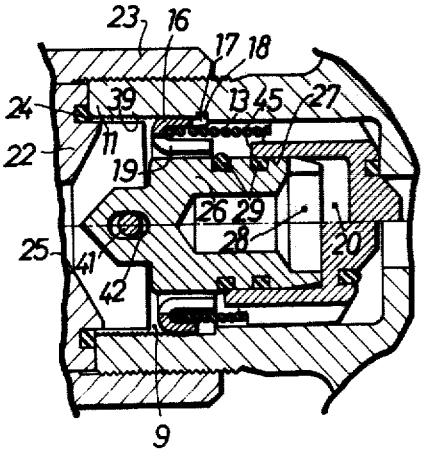
FIG. 4 is a cross sectional view on a larger scale of the gas-inlet attachment in FIG. 3.

Referring to FIGS. 3 and 4, a gas-inlet attachment is generally designated by reference numeral 40. The attachment 40 includes an inlet mouthpiece 22, which is detachably connected to the outlet mouthpiece 11 by means of a nut 23. The joint between the inlet mouthpiece 22 and the outlet mouthpiece 11 is sealed by means of an O-ring 24. In this way an inlet passage 25 in the inlet mouthpiece 22 is air-tightly communicated with the outlet passage 9.

Reference numeral 26 denotes a valve-opener which is air-tightly connectable to the check valve 12 under a pressure. The valve-opener 26 is supported on the inlet mouthpiece 22 such that the same can axially move. In the illustrated embodiment it is provided with an axially prolonged hole 42 at its tail portion in which a pin 41 is inserted with a sufficient allowance for the valve-opener 26 to move in its axial direction. However, it is not always necessary to connect the valve-opener to the inlet mouthpiece so long as its axial movement allows, which will be described hereinafter.

The top portion of the valve-opener 26 is slightly tapered at 43, hereinafter referred to as the tapered end. Its cylindrical outside surface includes O-rings 29 so as to constitute a sliding surface against the inside wall 27 of the recess 20. The valve-opener 26 is likewise provided with a recess 28, which is produced opposedly to the recess 20 in the check valve.

In operation, the gas-inlet attachment 40 is connected to the cock 1 firstly by inserting the valve-opener 26 into the outlet passage 9 through the ring-shaped seat metal 16, and then by fastening the nut 23 on the outlet mouthpiece 11. At this stage the valve-opener 26 is further inserted in the recess 20 at the pressure under the guidance provided by the inside wall 27 thereof. In this way the two recesses 20 and 28 are air-tightly communicated with each other.

As best shown in FIG. 4, the check valve 12 has two end faces 44 and 45 at its top and tail, respectively. The end face 44 is located adjacent to the O-ring 14, and the other end face 45 constitutes the entrance of the recess 20. The end face 44 has a larger cross-section than that of the end face 45, thereby providing an effective pressure receiving face.

FIG. 4 shows two different phases of the check valve 12; in the upper half the check valve is kept in its closing state under the action of the spring 13 whereas in the lower half the check valve is biased to the left under the gaseous pressure exerting on the end face 44. With the check valve being kept in its closing state as shown in the upper half of the drawing, a filling gas is initiated to be introduced into the container from a supply source (A) through a pipe 21 via the outlet passage 9. The gaseous pressure exerting on the end face 44 is larger than that on the end face 45, and as a result the check valve is gradually biased leftward. At this stage the pressure differentiator provided by the recesses 20 and 28 is effective to accelerate the leftward movement of the check valve. As the check valve is biased leftward, the same comes into abutment with the tapered end 43, thereby minimizing the reduction of the space defined by the recesses 20 and 28. As the check valve is biased leftward, the outlet port 8 is opened to allow the gas to enter the container. As described above, the movable range of the valve-opener 26 is extremely limited to the allowance provided by the prolonged hole 42. As a result, the check valve 12 is prevented from its further movement.

When the container 5 charges up with a fresh supply of gas, the main valve 3 is closed, and the introduction of gas from the supply source is stopped. Then the inlet mouthpiece 22 is detached by unfastening the nut 23. The check valve 12 returns to its original closing position under the action of the spring 13, and closes the outlet port 8.

Figure 5:
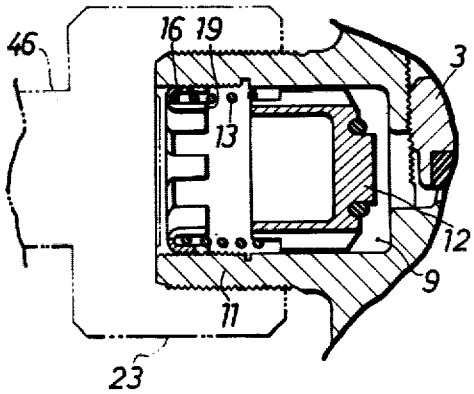
FIGS. 5 to 10 are cross sectional views of modified versions of embodiment in accordance with the present invention.

As shown in FIG. 5, when the content of the container 5 is to be vacuum-sucked, the seat metal 16 is slightly unfastened until the spring 13 becomes loose. Then a vacuum-suck mouthpiece 46 is engaged in the outlet mouthpiece 11. The check valve 12 is biased leftward under the suction to allow the passage of gas from the container 5.

Figure 6:
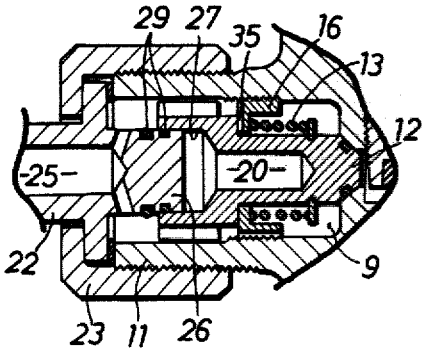
Figure 7:
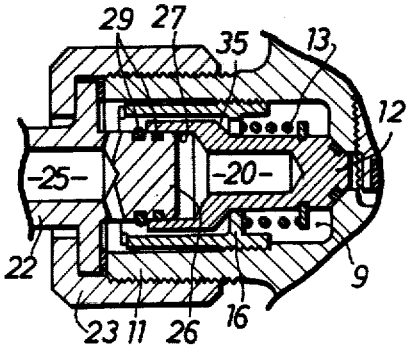
Figure 8:
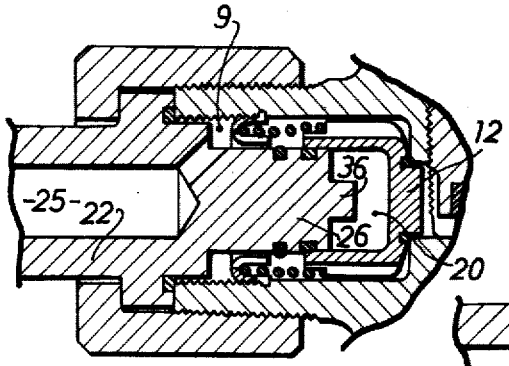

Various modified versions of the embodiment can be made within the spirit of the present invention, for example:

(A) As shown in FIGS. 6 and 7, the check valve 12 can be provided with a shoulder 35 on its outside surface, the shoulder being designed so as to support the seat metal 16. As a result, the check valve 12, the spring 13 and the seat metal 16 can be united into a unit. In addition, the recess 20 is two-staged so as to save the provision of the mating recess 28 in the valve-opener 26.

(B) When the recess 28 is omitted in the valve-opener 26, a projection 36 is preferably provided at the front face thereof for preventing an excessive leftward movement of the check valve 12.

Figure 9:
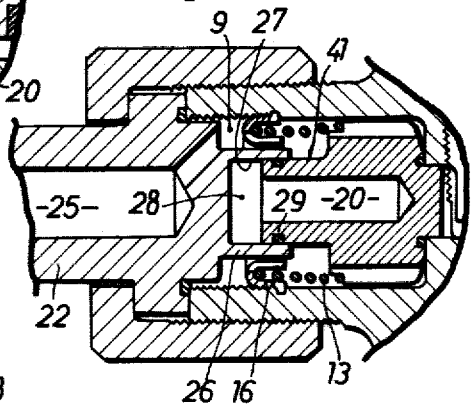

(C) The check valve 12 can be inserted into the recess 28 in the valve-opener 26, wherein the cylindrical outside surface 41 of the check valve is in air-tight contact with the inside wall 27 of the valve-opener 26. In this way the two recesses 20 and 28 are air-tightly communicated with each other, as shown in FIG. 9.

(D) In the embodiment of (C) the tapered end 43 is provided at the tail portion of the check valve 12, thereby enabling the check valve to be smoothly inserted in the recess 28.

Figure 10:
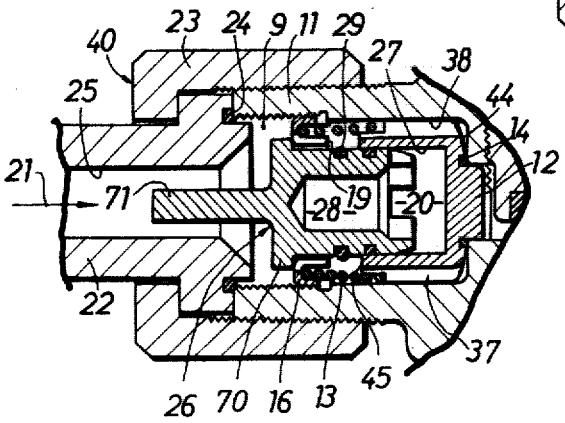

(E) In the embodiment illustrated in FIG. 10 the valve-opener 26 is provided with a relatively long tail 71, which is freely inserted into the inlet passage 25. In the first embodiment described hereinbefore, the valve-opener 26 is movably connected to the inlet mouthpiece 22 as best shown in FIG. 4. However, in this version the tail 71 has no connection to the inlet mouthpiece 22. In this case, it is necessary to provide the valve-opener 26 with a shoulder 70 of sufficient size to engage with the seat metal 16.

As is evident from the foregoing, various advantages are obtained with the present invention. For example, the following effects are particularly advantageous:

1. The charging gas is led from the supply source to the container in an air-tight confinement, thereby avoiding a leakage trouble. This makes it possible to deal with any gas of toxic or explosive nature;

2. The attachment can be readily and economically produced, and be applied to ready-made cocks without their modification;

3. The attachment can be easily fixed on the cock of a gas container; unlike a prior art attachment it can dispense with the difficulty of aligning its inlet passage with the outlet passage of the cock. There is no danger of damaging the check valve.

What is claimed is:

1. In a gas-inlet attachment for use in the mouthpiece of a gas charger, which is detachably connected to the cock of a gas container when the container is charged with a fresh supply of gas, the improvement of said gas-inlet attachment comprising:

said cock including a spring-closed check valve having a recess which opens toward said gas charger;

said check valve having at least one axial passage along its outer periphery to allow the passage of gas therethrough;

said mouthpiece of said gas charger including a pressure differentiator opposed to said check valve;

said pressure differentiator including an axially movable member air-tightly connectable to but movable relative to said check valve with a pressure differentiating space interposed therebetween, whereby to cause opening of said check valve by a pressure difference; and said mouthpiece of said gas charger including a sealing means for enabling the same to be air-tightly connected to said cock.

2. A gas-inlet attachment as set forth in claim 1, wherein said moving member is movably supported on said mouthpiece of said gas charger.

3. A gas-inlet attachment as set forth in claim 2, wherein said moving member is provided with a tail portion extending toward said mouthpiece of said gas charger, said tail portion including an axially prolonged hole at which said moving member is movably connected permitting limited movement of said check valve in an axial direction.

4. In a gas-inlet attachment for use in the mouthpiece of a gas charger, which is detachably connected to the cock of a gas container when the container is charged with a fresh supply of gas, the improvement of said gas-inlet attachment comprising:

said cock including a spring-pressed check valve at one side of said cock;

said check valve having at least one axial passage along its outer periphery to allow the passage of gas between said check valve and the adjacent portion of said cock;

said mouthpiece of said gas charger including a pressure differentiator opposed to said check valve;

said pressure differentiator including a surface along which said check valve is air-tightly slidable in the axial direction, wherein said surface is provided by said mouthpiece of said gas charger, and additionally including a pressure differentiating space air-tightly closed between said mouthpiece and said check valve whereby to cause opening of said check valve by a pressure difference; and said mouthpiece of said gas charger including a sealing means enabling the same to be air-tightly connected to said cock.

5. A gas-inlet attachment as set forth in claim 4, wherein said sliding surface is provided on the outside surface of said mouthpiece of said gas charger so as to enable said sliding surface to engage with the inside wall of said recess of said check valve, and wherein said mouthpiece includes a projection extending toward said check valve, thereby producing said pressure differentiating space against the bottom of said recess.

6. A gas-inlet attachment as set forth in claim 1, wherein said movable member includes a flange which is received by a stopper fixed on said cock.

* * * * *